US011591145B2

(12) United States Patent
Kim et al.

(10) Patent No.: US 11,591,145 B2
(45) Date of Patent: Feb. 28, 2023

(54) DEVICE FOR PACKAGING TWO PRODUCTS SEPARATELY

(71) Applicant: L'Oreal, Paris (FR)

(72) Inventors: Jin Seok Kim, Shanghai (CN); Vincent Jacquart, Shanghai (CN); Stéphane Leroux, Shanghai (CN)

(73) Assignee: L'Oreal, Paris (FR)

( * ) Notice: Subject to any disclaimer, the term of this patent is extended or adjusted under 35 U.S.C. 154(b) by 50 days.

(21) Appl. No.: 16/768,856

(22) PCT Filed: Dec. 1, 2017

(86) PCT No.: PCT/CN2017/114302
§ 371 (c)(1),
(2) Date: Jun. 1, 2020

(87) PCT Pub. No.: WO2019/104726
PCT Pub. Date: Jun. 6, 2019

(65) Prior Publication Data

US 2021/0163195 A1 Jun. 3, 2021

(51) Int. Cl.
*B65D 51/28* (2006.01)

(52) U.S. Cl.
CPC ..... *B65D 51/2878* (2013.01)

(58) Field of Classification Search
CPC ..... B65D 51/2878; B65D 51/2864; B65D 51/2885; B65D 51/2892; B65D 51/2871;
(Continued)

(56) References Cited

U.S. PATENT DOCUMENTS 3,326,400 A * 6/1967 Hamelin ..... B65D 51/2871 215/DIG. 8
3,355,238 A * 11/1967 Schwartzman .... B65D 51/2871 401/41
(Continued)

FOREIGN PATENT DOCUMENTS

JP H10273161 A * 10/1998
JP H102731161 A * 10/1998
(Continued)

*Primary Examiner* — Steven A. Reynolds
*Assistant Examiner* — Prince Pal
(74) *Attorney, Agent, or Firm* — Christensen O'Connor Johnson Kindness PLLC

(57) ABSTRACT

Device (10) for packaging two products (A, B) separately and dispensing a resulting mixture (M) on a first use, comprising a lower container (12) delimiting a first product cavity (22) containing a first product (A) and an upper container (14) delimiting a second product cavity (24*c*) containing a second product (B), and being capable of rotating relative to the lower container (12) without moving axially, and a temporary closing member (30) configured to close an opened end (24*b*) of the upper container (14) before the first use, and comprising a cylindrical skirt (32) surrounding said opened end (24*b*) and a plug (34) connected to said cylindrical skirt (32), said cylindrical skirt (32) being designed to cooperate by thread engagement with the upper container (14) and being prevented from rotating relative to the lower container (12). The closing member (30) is deprived from any axially retaining members with both containers (12, 14), such that when the upper container (14) is rotated in a first rotation direction (F1), the closing member translates downwardly until falling into the first product cavity (22).

14 Claims, 7 Drawing Sheets

(58) Field of Classification Search
CPC ..... B65D 35/22; B65D 35/24; B65D 35/40; B65D 47/106; B65D 47/244; B65D 47/38; Y10S 215/08; A61J 1/202; A61J 1/2024; A61J 1/2027; A61J 1/2093
USPC ..... 206/219, 581; 215/DIG. 8, 6
See application file for complete search history.

(56) References Cited

U.S. PATENT DOCUMENTS 3,439,823 A * 4/1969 Morane ..... B65D 51/2878 215/DIG. 8
4,203,517 A * 5/1980 Hildebrandt ..... B65D 51/2871 215/DIG. 8
5,419,445 A * 5/1995 Kaesemeyer ..... A61J 11/04 215/11.4
5,944,175 A * 8/1999 Albisetti ..... B65D 81/3211 215/DIG. 8
5,992,693 A * 11/1999 Albisetti ..... B65D 81/3211 222/129
6,073,803 A * 6/2000 Sturm ..... B65D 51/2871 222/129
6,293,395 B1 * 9/2001 Hof ..... B65D 81/3211 206/219
8,403,131 B2 * 3/2013 Rovelli ..... B65D 51/2835 220/521
8,413,802 B2 * 4/2013 Lee ..... B65D 51/2864 206/219
2003/0017236 A1 * 1/2003 Makita ..... B65D 51/2864 426/115
2004/0020797 A1 * 2/2004 Fontana ..... B65D 51/285 206/219
2004/0159562 A1 * 8/2004 Takahashi ..... B65D 21/083 206/219
2005/0211579 A1 * 9/2005 Makita ..... B65D 51/2842 206/219
2005/0263414 A1 * 12/2005 Harilela ..... B05B 11/0081 206/219
2007/0029345 A1 * 2/2007 Lee ..... B65D 51/2878 222/145.1
2009/0205506 A1 * 8/2009 Lin ..... B65D 51/2878 215/250
2013/0008808 A1 * 1/2013 Lee ..... B65D 47/243 215/227
2013/0240533 A1 * 9/2013 Cho ..... B65D 51/2892 220/521
2017/0181524 A1 * 6/2017 Thiebaut ..... A45D 34/045
2020/0324945 A1 * 10/2020 Song ..... A61M 35/003
2021/0163195 A1 * 6/2021 Kim ..... B65D 51/2878

FOREIGN PATENT DOCUMENTS

JP 2000095278 A * 4/2000 ..... B65D 51/2842
JP 2010083534 A * 4/2010

* cited by examiner

DEVICE FOR PACKAGING TWO PRODUCTS SEPARATELY

The present invention relates to a device for packaging two products separately that must be kept separated during transport and storage, which products are to be mixed on first used, and for dispensing the resulting mixture.

More particularly the present invention relates to a device comprising two superposed containers, which are capable of turning one relative to the other and which are suitable for communicating with each other.

One advantageous application of the invention is the use of the multiple-compartment device for packaging cosmetic products, such as cosmetic products for dyeing human keratin fibers. Other advantageous applications of the invention may be the use of the multiple-compartment container to store care products, adhesive products, polymer coatings, flavoured liquids, etc.

The expression "cosmetic product" is understood to mean a product as defined in Article 2 of Regulation No. 1223/2009 of the European Parliament and of the Council of 30 Nov. 2009.

Referenced can be made to document JP 2010/083534-A1 which describes a device for packaging two separate components comprising a container body, a powder storage chamber fitted in a non-rotatable manner with respect to the container body, a plug member for closing said powder storage chamber before the first use and a nozzle member configured to transmit rotational movement to said plug member. The plug member is capable of rotating compared to the container body and to be screwed downwardly until falling into the container body when the nozzle member is rotated with respect to the container body.

However, such device comprises a large number of components and is particularly difficult to manufacture.

Referenced can also be made to document U.S. Pat. No. 5,944,175-B1 (L'Oréal) which describes a device for packaging two separate components having a lower container containing a first product, an upper container containing a second product, which are capable of turning one relative to the other, and a shutter for closing the upper container. Said shutter comprises a plug connected to a holding member by a hinge-forming bridge. The device further comprises means for preventing the rotation of the holding member relative to the containers when the containers are rotated relative to one another.

Therefore, when the upper container is rotated relative to the lower container in a first rotation direction, the holding member of the shutter translates upwardly, causing the plug to pivot from a first position of closing the upper container to a second position of opening the upper container.

However, the holding member being held axially on the lower container by an annular rim, when the user rotates the upper container in a second rotation direction, opposite to the first rotation direction, the holding member of the shutter translates downwardly until said annular rim bears on an inner shoulder of the lower container, which may cause the plug to pivot back from the second position to the first position.

The upper container can thus be closed inadvertently by a user, causing an inappropriate use of the device.

The aim of the present invention is to overcome the aforementioned drawbacks.

One aim of the present invention is to provide a device for packaging two separate products of simple structure, easy to manufacture and easy to use.

Another aim of the present invention is also to provide a device in which, once the upper container has been opened to let the product contained in said upper container flow towards the lower container, the shutter cannot reseal or reclose the aforementioned upper container.

The object of the present invention is to provide a device for packaging two products separately and dispensing a resulting mixture on a first use. Said device comprises a lower container delimiting a first product cavity containing a first product and an upper container delimiting a second product cavity containing a second product, said containers being capable of rotating one relative to the other without moving axially.

Said device further comprises a temporary closing member configured to close an opened end of the upper container before the first use. The temporary closing member comprises a cylindrical skirt surrounding said opened end and a plug connected to said cylindrical skirt.

Said cylindrical skirt is provided, on its inner cylindrical surface, with inner threads cooperating with outer threads provided on the upper container and on its outer cylindrical surface, with first anti-rotation means cooperating with second anti-rotation means provided on the lower container for preventing rotation between the closing member and the lower container.

The closing member is deprived from any axially retaining members with both containers, such that when the upper container is rotated in a first rotation direction, the closing member translates downwardly until falling into the first product cavity.

The upper container is in the form of a cap for the lower container and comprises a central dispensing chimney or duct defining the second product cavity with the temporary closing member when this latter closes the opened end of the upper container, and allowing the dispensing there through of the resulting mixture of the first and second products when the temporary closing member has been moved to open the opened end of the upper container.

Advantageously, the closing member comprises a bridge of hinge-forming material and at least one link or bonds of breakable material connecting the plug to the cylindrical skirt, such that when the upper container is rotated in a second rotation direction, opposite to the first rotation direction, the closing member translates upwardly until the breakable link is broken by force causing the plug to pivot around the bridge of hinge-forming material between a first position where the opened lower end is closed to a second position where the opened lower end is opened so that the second product flows towards the first product cavity of the lower container.

The user may thus open the second product cavity by rotating the upper container in both rotation directions.

According to an embodiment, the closing member comprises a plurality of links of breakable material regularly spaced apart on the circumference of the plug.

According to another embodiment, the closing member comprises at least one axially projecting block provided on a lower surface of the plug.

For example, the closing member comprises a plurality of axially projecting blocks provided on the lower surface of the plug. The axially projecting blocks may be being disposed circumferentially on the lower surface of the plug and are regularly spaced apart from each other.

Advantageously, the blocks are disposed on a diameter of the plug substantially equal to the diameter of the opened end, so that when the closing member is dropped in the lower container, the blocks avoid obstructing the opened lower end of the upper container.

Indeed, when using the device, in case the closing member comes in front of the opened lower end of the upper container, said closing member will bear against said lower end with its blocks, thus allowing the mixture contained in the lower container to flow between the blocks in the second product cavity when turning said device upside-down.

The plug may comprise an annular sealing lip on its upper surface configured to close the opened end of the upper container in a sealed manner. For example, the annular sealing lip is provided with an annular groove for reducing the surface contact with the upper container and thus the force needed to break the breakable links.

Advantageously, the upper container is provided with an annular axial sealing lip configured to bear closely against a radially inside surface of the lower container, thereby providing sealing between the lower container and the upper container.

For example, the annular sealing lip extends substantially along the longitudinal axis down into an annular channel formed between the dispensing chimney and the assembly skirt. The sealing lip bears closely against the radially inside surface of the top portion of the neck of the lower container.

The annular sealing lip of the upper container is, for example, provided with an outer annular groove, in order to reduce the surface contact with the lower container.

In one embodiment, the upper container comprises an upper portion, opposite to the open lower end, and having a dispensing frangible end piece or tearable tab designed to be broken for first use of said device in order to open a first dispensing orifice in flow communication with the second product cavity.

In another embodiment, the upper container comprises a plurality of application teeth, the frangible end-piece being located between said application teeth and provides access to a second dispensing orifice communicating with the first dispensing orifice.

For example, the upper container comprises an application member mounted on the dispensing chimney and comprising said plurality of application teeth.

Alternatively, the dispensing chimney, the assembly skirt and the dispensing member could be made in one single piece.

Advantageously, the lower container is manufactured with injection blow molding process, such that the second anti-rotation means are manufactured directly during injection blow molding process of the lower container.

The lower container is, for example, made in polymer material, such as thermoplastic material. The lower container can be injection molded onto a preform core consisting of the container neck with a thick tube of polymer material attached. The preform core is provided with outer anti-rotation means which will form the anti-rotation means provided on the inner circumferential surface of the neck of the lower container when compressed air is filled into the preform for inflating the thick tube into the bottle shape of the lower container.

For example, the first anti-rotation means are longitudinal ribs provided on the outer cylindrical surface of the cylindrical skirt, said longitudinal ribs cooperating with inner longitudinal ribs provided on the inner surface of the lower container. The inner longitudinal ribs forms the second anti-rotation means.

The present invention will be better understood from studying the detailed description of an embodiment considered by way of a non-limiting example and illustrated by the attached drawings in which:

FIGS. 1 to 5 show an example of a device for packaging two products separately and dispensing a mixture M of those two products on first use, denoted by the general reference number 10.

Figure 1:
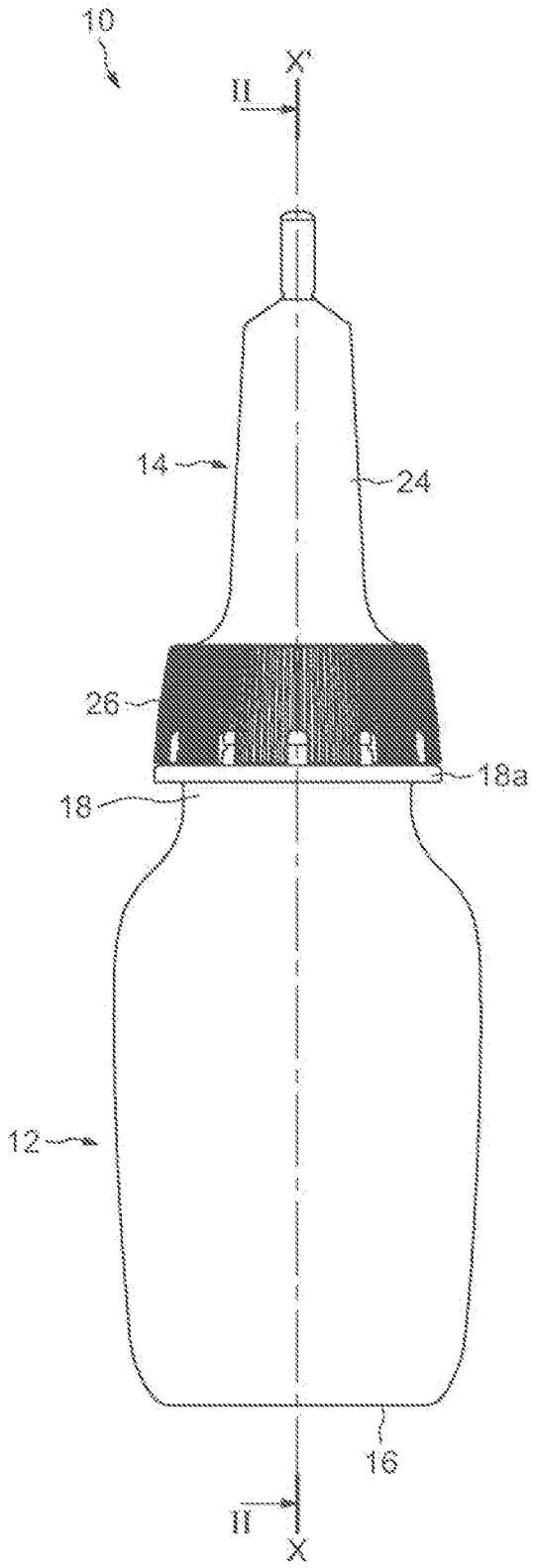
FIG. 1 is a front view of a device according to a first embodiment of the present invention.

The device 10 may be used for packaging two cosmetic products A and B, for example two liquid or semi-liquid cosmetic products, or a liquid product and a powder. For example, the products may be hair products, such as, hair-care products, for example, hair dye, cream hair or the any product used for hair. However, it might be possible to provide the packaging and dispensing of other types of products. The device 10 is suited for one application products. By way of example, the first product A is an oxidative colorant and the second product is an oxidant agent B which when mixed together to make a mixture M forms a hair dye.

The device 10 may also be used for packaging other types of cosmetics products such as skin care products, or other types of products like food products, such as flavoured liquids, or any products that may be kept separated during transport and storage, such as adhesive products, polymer coatings, etc.

The device 10 extends along a longitudinal axis X-X' assumed to be vertical on the Figures. The device 10 comprises a lower container 12 and an upper container 14 that are capable of turning one relative to the other about said longitudinal axis X-X'.

The lower container 12 has the shape of a bottle having an elongated body along the longitudinal axis provided with a closed lower end 16 forming a bottom and an upper end 18 forming a neck provided with an opening 20, opposite the lower end 16, allowing access to the internal cavity 22 containing the first product A.

In the embodiment illustrated, the neck 18 has an outer diameter smaller than the outer diameter of the body of the lower container 12 and comprises, on its outer surface, two outer annular shoulders 18*a* delimiting an annular groove

18*b*. The body of the lower container 12 may be made, for example, of rigid plastic material.

The upper container 14 is in the form of a cap and comprises a central dispensing chimney or duct 24 containing the second product B having an upper portion shaped with a dispensing frangible end piece 24*a* and a lower end provided with an opening 24*b*, opposite to the frangible end piece 24*a*, and allowing access to an internal cavity 24*c* containing the second product B. The dispensing frangible end piece 24*a* is designed to be broken for first use in order to open a dispensing orifice 24*d* in flow communication with the internal cavity 24*c*.

The dispensing chimney 24 is surrounded by an assembly skirt 26 provided on its radially inner surface with an annular bead 26*a* cooperating with the annular groove 18*b* of the lower container 12 by snap-fit attachment, such that the upper container 14 is held axially relative to the lower container 12, while allowing a rotating movement one relative to the other.

The upper container 14 has an annular sealing lip 28 extending substantially along the longitudinal axis X-X' down into an annular channel 14*a* formed between the dispensing chimney 24 and the assembly skirt 26. The sealing lip 28 is annular and bears closely against the radially inside surface of the top portion 18*c* of the neck 18, which surface is annular, thereby providing sealing between the lower container 12 and the upper container 14.

Figure 2:
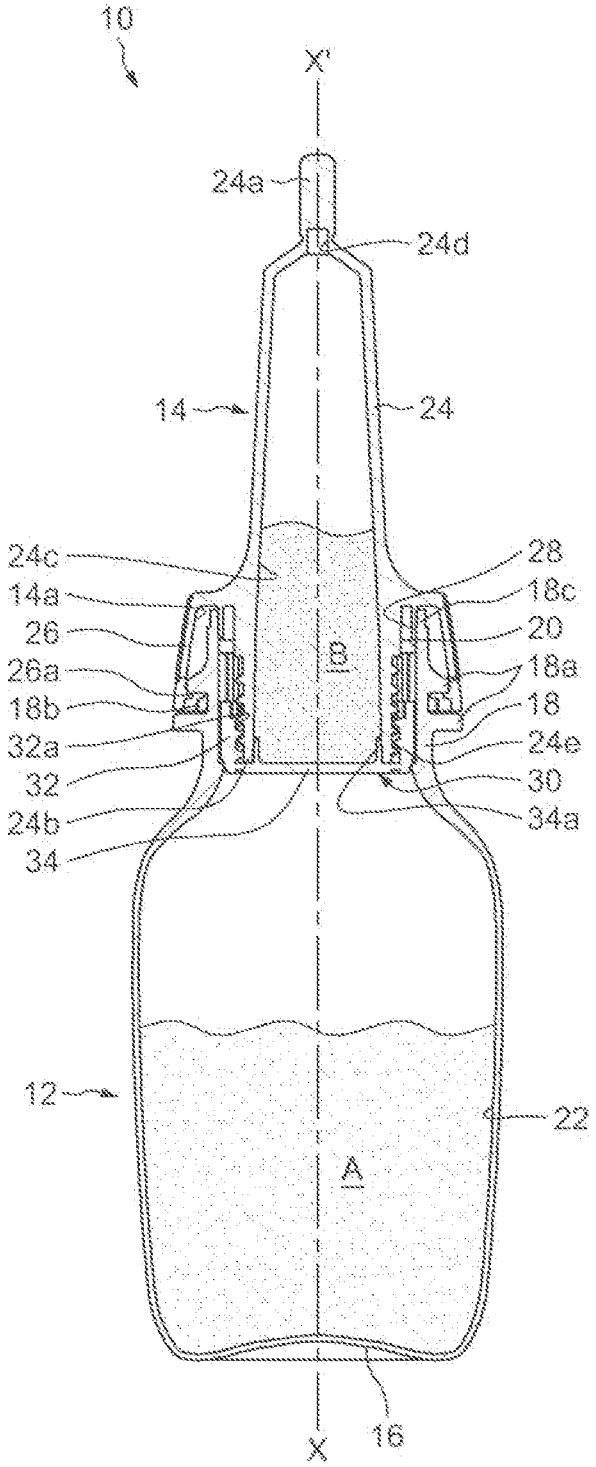
FIG. 2 is a cross section view along line II-II of the device of FIG. 1.
Figure 3:
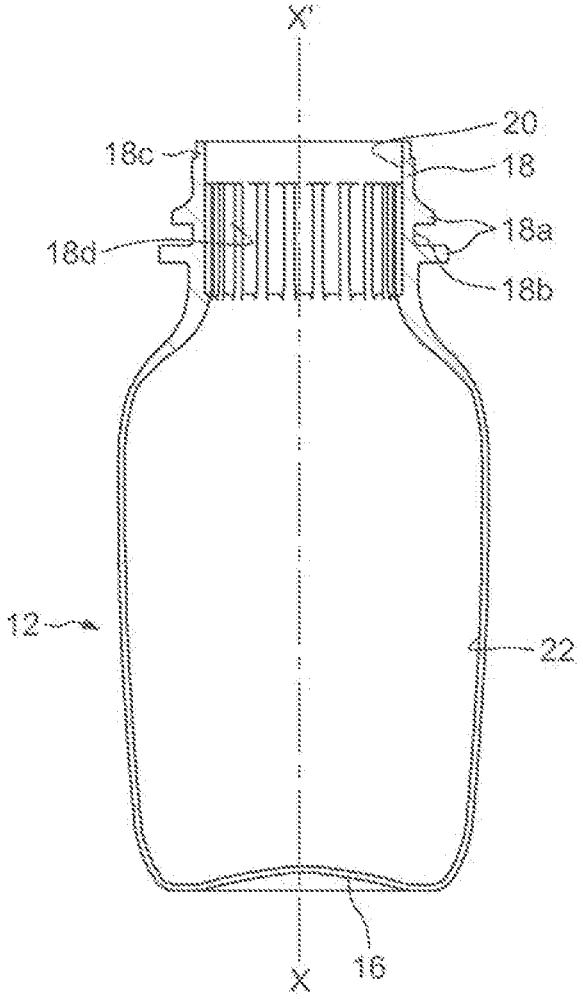
FIG. 3 is a cross view of a lower container of the device of FIG. 1, showing anti-rotation means.

As illustrated in FIG. 2, during transport and before the first use, the opened end 24*b* of the upper container 14 is closed off by a temporary closing member 30. In the example illustrated, the closing member 30 is a lid that is able to be screwed, in a sealed manner, onto an outer thread 24*e* provided on the outer surface of the lower end 24*b* of the dispensing chimney 24, between the dispensing chimney 24 and the inner surface of the neck 18.

The closing member 30 comprises a cylindrical skirt 32 and a plug 34 connected to said skirt 32. The cylindrical skirt 32 extends radially between the neck 18 of the lower container 12 and the lower end 24*b* of the dispensing chimney 24 of the upper container 14.

The cylindrical skirt 32 is provided on its inner cylindrical surface with inner threads 32*a* cooperating with the outer thread 24*e* of the dispensing chimney 24.

The cylindrical skirt 32 is further provided on its outer cylindrical surface with outer longitudinal ribs 32*b* regularly spaced apart on the whole circumference of the cylindrical skirt 32. Said outer longitudinal ribs 32*b* cooperate with inner longitudinal ribs 18*d* provided on the inner circumferential surface of the neck 18, such that the closing member 30 is prevented from rotating relative to the lower container 12.

As illustrated and in a non-limiting example, the outer longitudinal ribs 32*b* extend axially beyond the upper surface of the cylindrical skirt 32.

In the example shown, the outer diameter of the plug 34 is larger than the outer diameter of the opened end 24*b* of the dispensing chimney 24.

The cylindrical skirt 32 and the lower container 12 may be provided with anti-rotation means having a different shape than longitudinal ribs. Generally, the cylindrical skirt 32 and the lower container 12 are provided with anti-rotation means for preventing the closing member 30 from rotating relative to the lower container 12.

The upper surface of the plug 34 comprises an annular sealing lip 34*a* having an outer diameter substantially equal to the inner diameter of the dispensing chimney 24 in order to be inserted into said dispensing chimney 24 and to close it in a sealed manner.

The device 10 is assembled as follows.

The upper container 14 is filled with the second product B and the closing member 30 is screwed onto the dispensing chimney 24 until the plug 34 bears axially against the opened end 24*b* of said dispensing chimney 24.

The upper container 14 is fitted in a simple translation movement along the longitudinal axis X-X' on the lower container 12 which has been previously filled with the first product A, until the assembly skirt 26 of the upper container 14 snap-fasten onto the neck 18 of the lower container 12.

Figure 5:
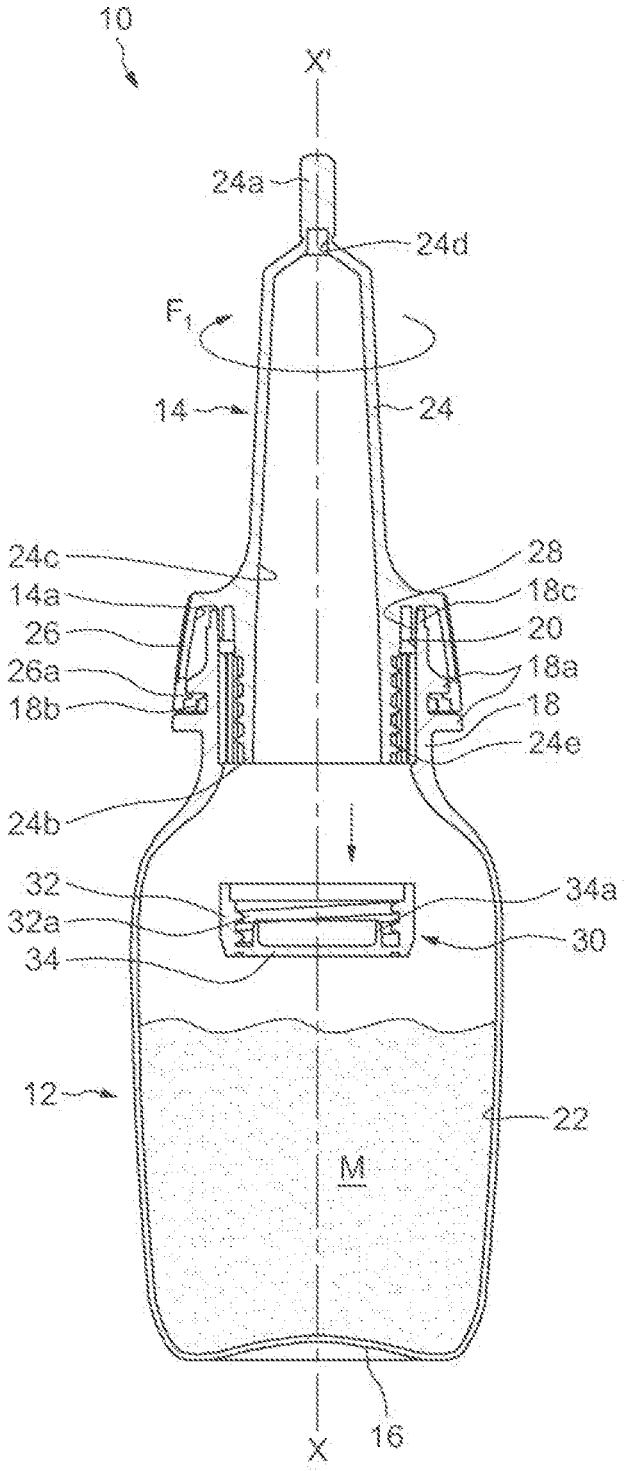
FIG. 5 shows the device of FIG. 1 in an opened position of an upper container after rotation of the upper container in a first rotation direction.

In order to put the inner volume 24*c* of the upper container 14 in flow communication with the inner volume 22 of the lower container 12 on first use of the device 10, the user turns the upper container 14 relative to the lower container 12 in a first rotation direction F1, as shown on FIG. 5, causing the closing member 30 to translate downwardly along the longitudinal axis X-X' compared to the lower container 12 until falling into the inner volume 22 of said lower container 12.

As illustrated on FIG. 5, and in a non-limited example, the first rotation direction F1 is a clockwise direction. The first rotation direction could also be a counter-clockwise direction.

In this embodiment, once the closing member 30 is in the inner volume 22 of the lower container 12, said closing member acts as a stirring member for the mixture M comprising the first and second products A, B by twist and shaking movements of the device 10.

The user then breaks the frangible end-piece 24*a* for using the device 10 and dispensing the resulting mixture M contained in the lower container 12 through the dispensing chimney 24 and the dispensing orifice 24*d*.

The lower container 12 may be processed with injection blow molding process. The lower container 12 is made for example in polymer material, such as thermoplastic material. The lower container 12 is, for example, injection molded onto a preform core consisting of the container neck with a thick tube of polymer material attached. The preform core has longitudinal outer ribs which will form the anti-rotation longitudinal ribs 18*d* provided on the inner circumferential surface of the neck 18 when compressed air is filled into the preform for inflating the thick tube into the bottle shape of the lower container.

The longitudinal anti-rotation ribs 18*d* are thus manufactured directly during injection blow molding process of the lower container 12.

Figure 6:
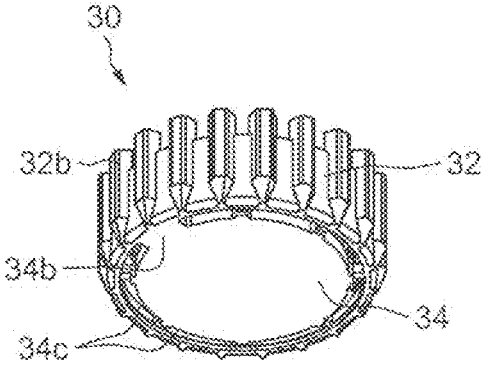
FIG. 6 is a perspective view of a closing member according to a second embodiment.
Figure 7:
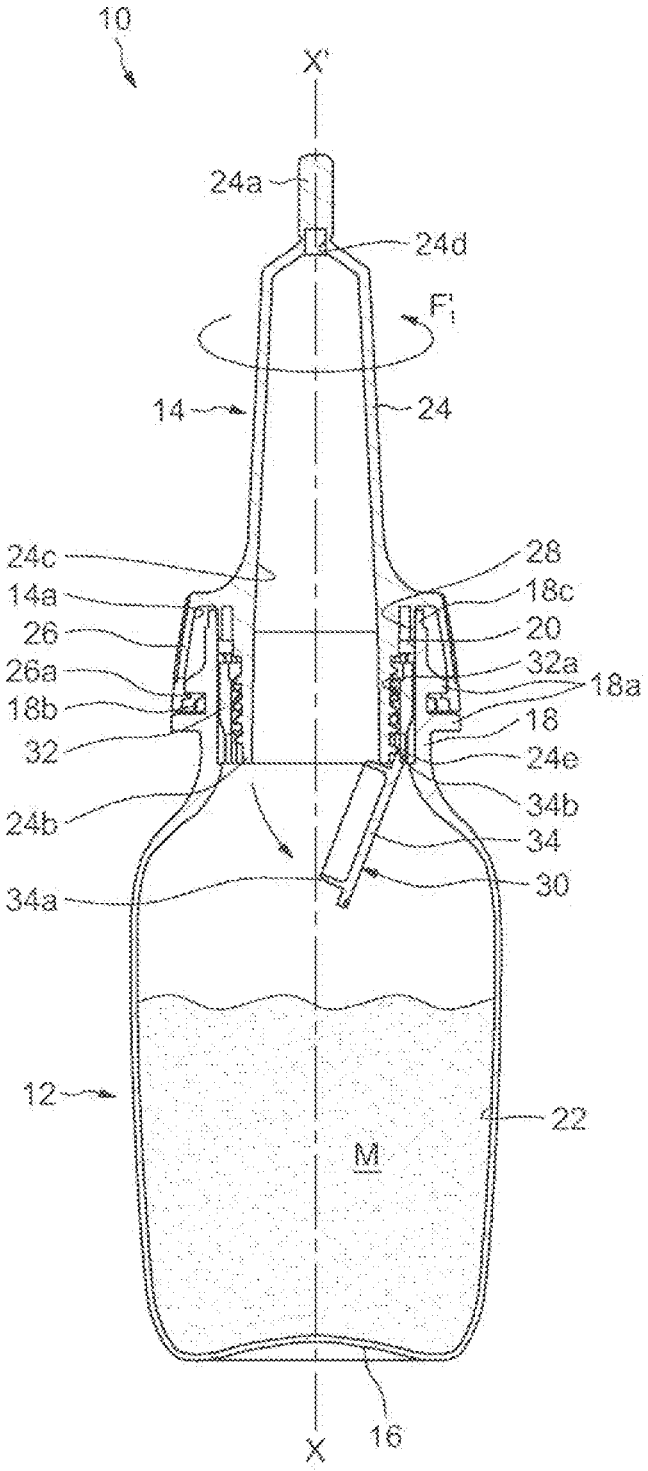
FIGS. 7 and 8 shows the device of FIG. 1 having the closing member of FIG. 6, in which the upper container is in an opened position after rotation of the upper container in two opposite rotation directions.

The embodiment as shown on FIGS. 6 and 7, in which the same elements bear the same references, differ from the embodiment of FIGS. 1 to 5 only by the fact that the plug 34 is connected by a bridge of hinge-forming material 34*b* and by links or bonds of breakable material 34*c* to the cylindrical skirt 32. In the embodiment shown on the Figures, there are seven links of breakable material 34*c* regularly spaced apart on the circumference of the plug 34. It could be possible to provide a number of breakable links 34*c* different than seven. For example, the plug 34 is connected to the cylindrical skirt 32 by a bridge of hinge-forming material 34*b* and by at least one breakable link 34*c*.

When the user rotates the upper container in a rotation direction F2, as shown on FIG. 7, the closing member 30 translates upwardly until the breakable links 34*c* are broken by force causing the plug 34 to pivot around the bridge of hinge-forming material 34*b* and the second product B to flow towards the inner cavity 22 of the lower container 12.

As illustrated on FIG. 7, and in a non-limited example, the first rotation direction F1' is a counter-clockwise direction. The first rotation direction F1' could also be a clockwise direction as in FIG. 5.

Figure 8:
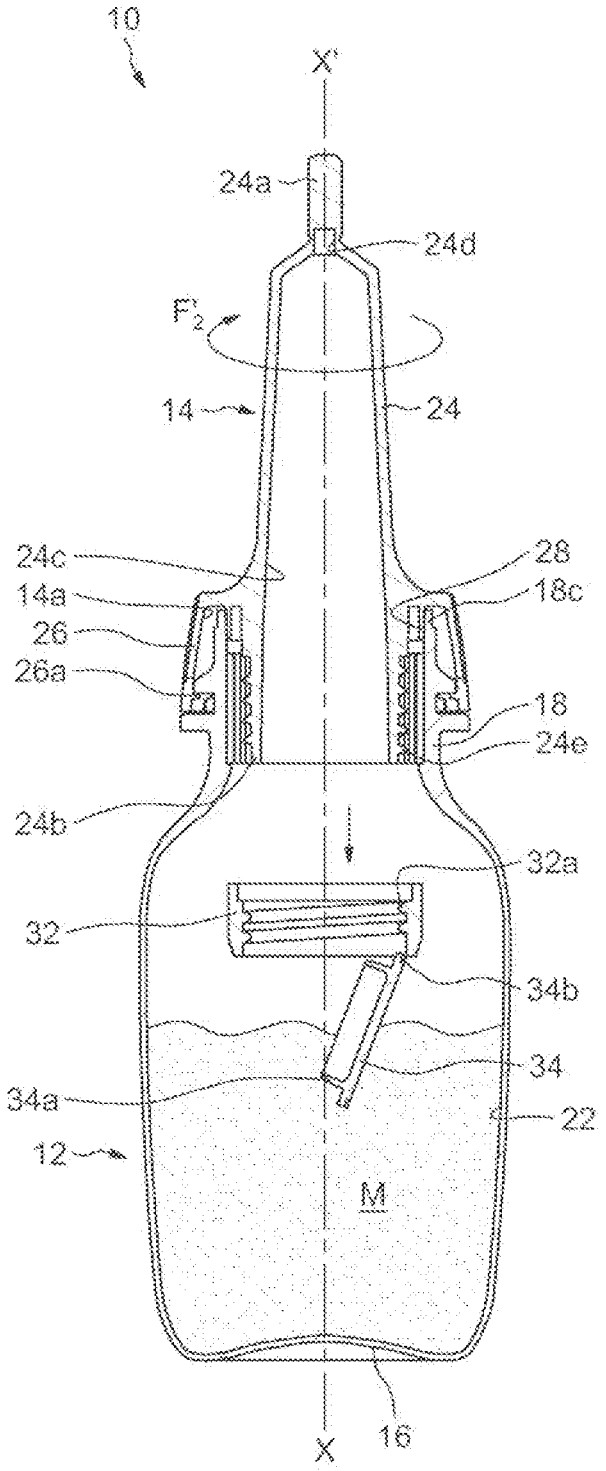

As shown on FIG. 8, when the user rotates the upper container 14 in a second rotation direction F2', opposite to the first rotation direction F1', the closing member 30 translates downwardly until falling into the inner cavity 22 of the lower container 12, the dispensing chimney 24 of the upper container 14 is thus in an opened position and the second product B flows inside the inner cavity 22 of the lower container 12.

In this embodiment, the user may open the dispensing chimney 24 by rotating the upper container 14 in both rotation directions F1', F2'.

Figure 9:
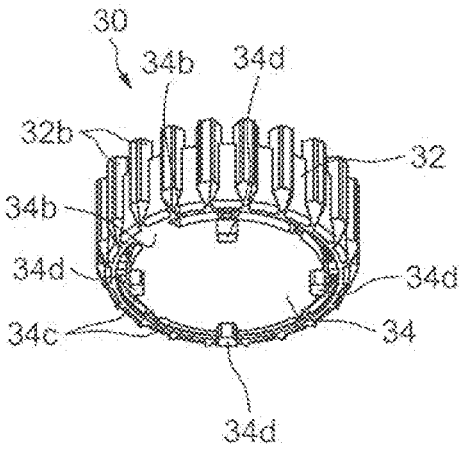
FIG. 9 is a perspective view of a closing member according to a third embodiment.

The embodiment as shown on FIG. 9, in which the same elements bear the same references, differ from the embodiment of FIG. 6 only by the fact that the plug 34 comprises a plurality of axially projecting bars or blocks 34*d* provided on the lower surface of the plug 34, opposite to the upper surface of the plug 34 having the annular sealing lip 34*a*. The axially projecting blocks 34*d* are disposed circumferentially on the lower surface of the plug 34 and are regularly spaced apart from each other.

As illustrated on FIG. 9, there are four blocks 34*d*. However, the number of blocks 34*d* is not limited to four and may be for example equal to one, two or three, or higher than four.

The blocks 34*d* are disposed on a diameter of the plug 34 substantially equal to the diameter of the dispensing chimney 24, so that when the closing member 30 is dropped in the lower container 12, the blocks 34*d* avoid obstructing the opened lower end 24*b* of the dispensing chimney 24.

Indeed, when using the device 10, in case the closing member 30 comes in front of the opened lower end 24*b* of the dispensing chimney 24, said closing member 30 will bear against said lower end 24*b* with its blocks 34*d*, thus allowing the mixture M contained in the lower container 12 to flow between the blocks 34*d* in the upper container 14 when turning said device 10 upside-down.

Figure 4:
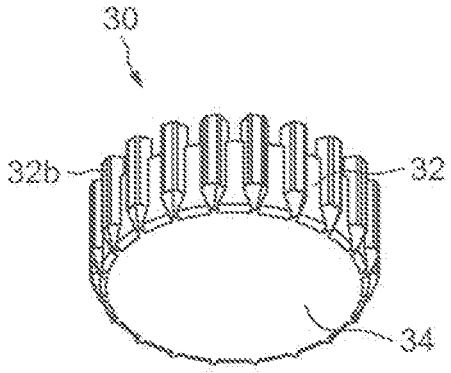
FIG. 4 is a perspective view of a closing member of the device of FIG. 1.

Such blocks 34*d* may also be added on the closing member 30 of the embodiment shown on FIG. 4.

Figure 10:
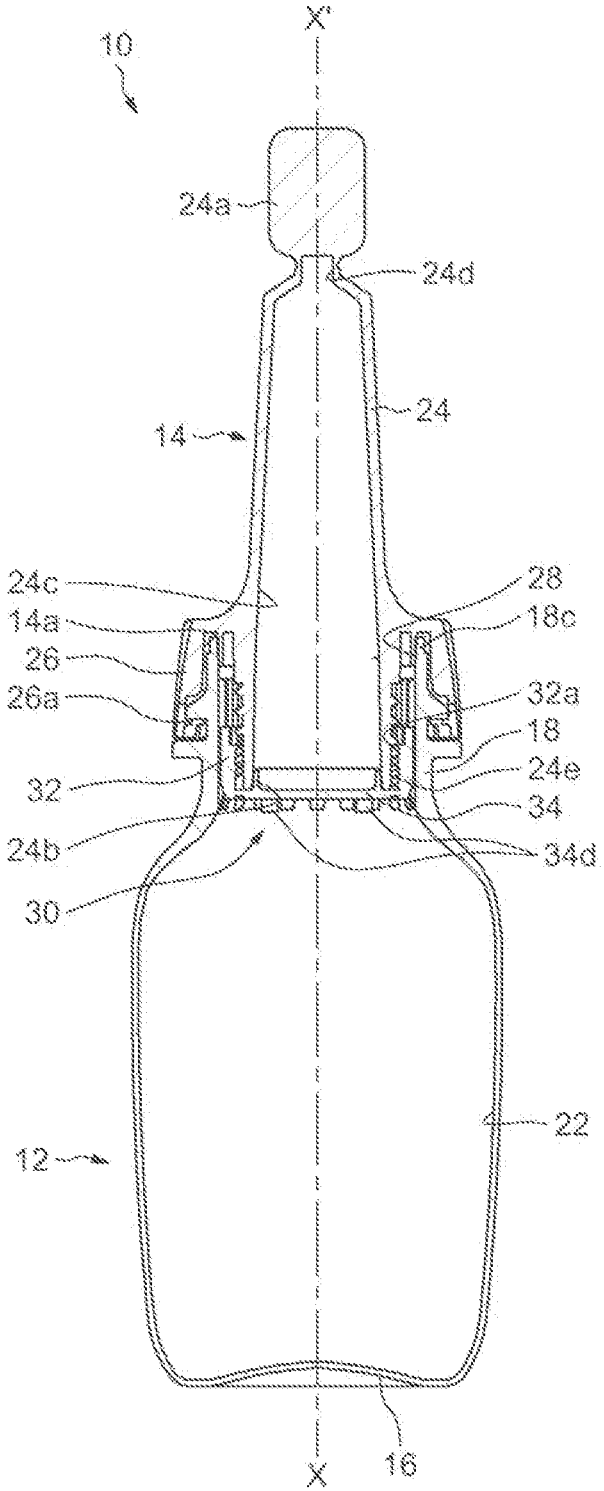
FIG. 10 is a cross section view of a device according to another embodiment of the present invention.
Figure 11:
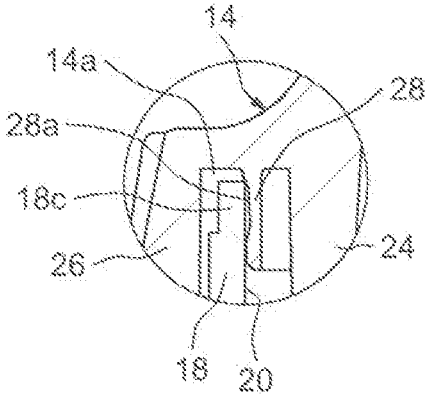
FIGS. 11 and 12 show example of the device of FIG. 9.
Figure 12:
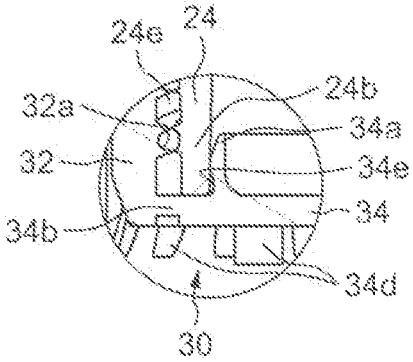

The embodiment as shown on FIGS. 10 to 12, in which the same elements bear the same references, differ from the embodiment of FIG. 8 only by the shape of the sealing lip 28 of the upper container 14 and the shape of the annular sealing lip 34*a* of the plug 34 of the closing member 30.

As shown on FIG. 11, the annular sealing lip 28 of the upper container 14 is provided with an outer annular groove 28*a* in order to reduce the surface contact with the neck 18 of the lower container 12.

As shown on FIG. 12, the annular sealing lip 34*a* of the plug 34 is provided with an outer annular groove 34*e* in order to reduce the surface contact with the dispensing chimney 24 at its opened lower end 24*b* and thus between the closing member 30 and the upper container 14.

Thanks to the reduced contact surfaces, the strength necessary for the user to break the breakable links 34*c* of the closing member 30 is reduced.

Figure 13:
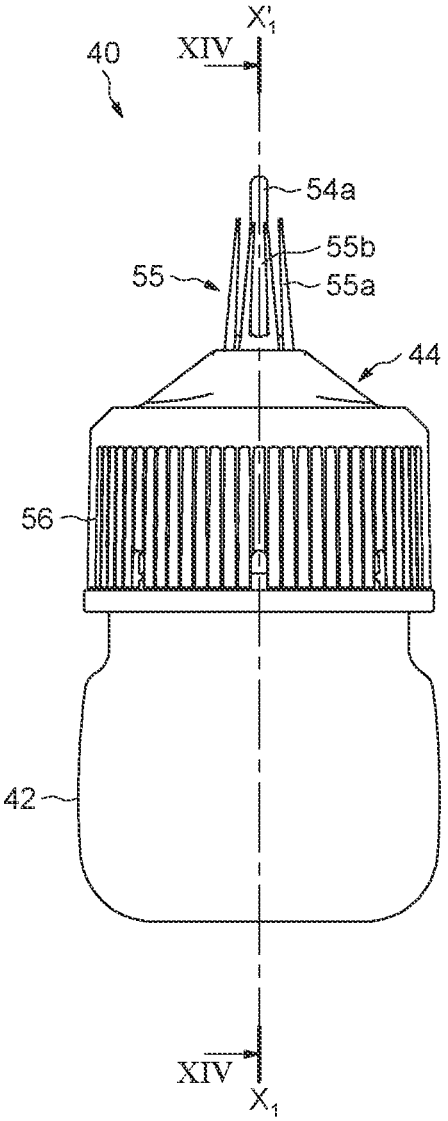
FIG. 13 is a front view of a device according to another embodiment of the present invention.
Figure 14:
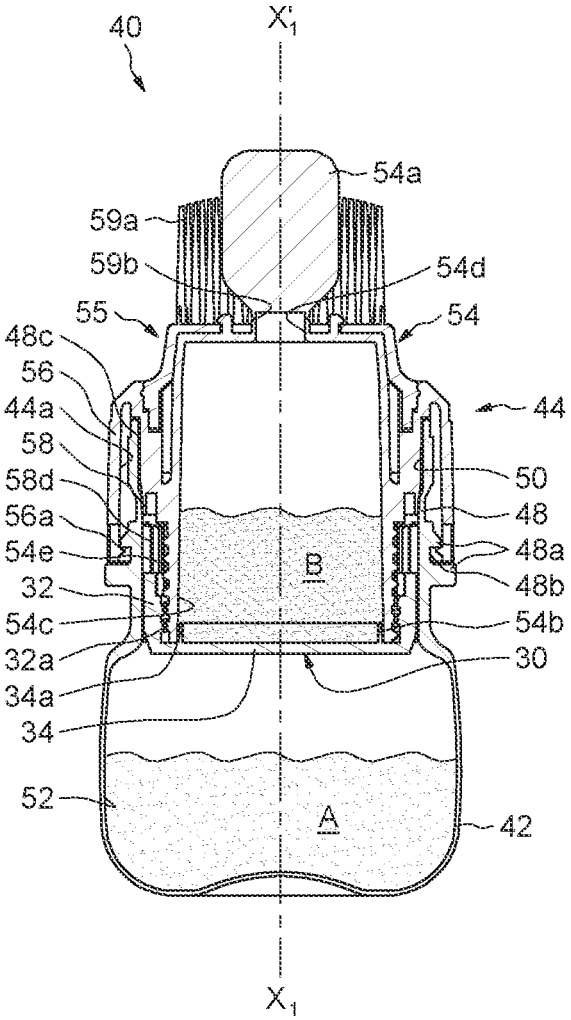
FIG. 14 is a cross section view along line XIV-XIV of the device of FIG. 13.

The embodiment as shown on FIGS. 13 and 14, in which the same elements bear the same references, differ from the embodiment of FIGS. 1 to 5 only by the shape of the upper container.

The device 40 as shown in FIGS. 13 and 14 may be used for packaging two cosmetic products A and B, for example two liquid or semi-liquid cosmetic products, or a liquid product and a powder. For example the products may be hair products, such as, hair-care products, for example, hair dye, cream hair or the any product used for hair. However, it might be possible to provide the packaging and dispensing of other types of products. The device 40 is suited for one application products. By way of example, the first product A is an oxidative colorant and the second product is an oxidant agent B which when mixed together to make a mixture M forms a hair dye.

The device 40 extends along a longitudinal axis X-X' assumed to be vertical on the Figures. The device 40 comprises a lower container 42 and an upper container 44 that are capable of turning one relative to the other about said longitudinal axis X1-X1'.

The lower container 42 has the shape of a bottle having an elongated body along the longitudinal axis provided with a closed lower end 46 forming a bottom and an upper end 48 forming a neck provided with an opening 50, opposite the lower end 46, allowing access to an internal cavity 52 containing the first product A.

In the embodiment illustrated, the neck 48 has an outer diameter smaller than the outer diameter of the body of the lower container 42 and comprises, on its outer surface, two outer annular shoulders 48*a* delimiting an annular groove 48*b*. The body of the lower container 42 may be made, for example, of rigid plastic material.

The upper container 44 is in the form of a cap and comprises a central dispensing chimney or duct 54 containing the second product B having an upper portion shaped with a dispensing frangible end piece or tearable tab 54*a* and a lower end provided with an opening 54*b*, opposite to the frangible end piece 54*a*, and allowing access to an internal cavity 54*c* containing the second product B. The dispensing frangible end piece 54*a* is designed to be broken for first use in order to open a first dispensing orifice 54*d* in flow communication with the internal cavity 54*c*.

The upper container 44 further comprises an application member 55 mounted on the dispensing chimney 54 and comprising a plurality of application teeth 55*a*. The frangible end-piece 54*a* is located between the application teeth 55*a* and provides access to a second dispensing orifice 55*b* communicating with the first dispensing orifice 54*d*.

Alternatively, the dispensing chimney 54 and the dispensing member 55 could be made in one single piece.

The dispensing chimney 54 is surrounded by an assembly skirt 56 provided on its radially inner surface with an annular bead 56*a* cooperating with the annular groove 48*b* of the lower container 42 by snap-fit attachment, such that the upper container 44 is held axially relative to the lower container 42, while allowing a rotating movement one relative to the other.

The upper container 44 has an annular sealing lip 58 extending substantially along the longitudinal axis X-X' down into an annular channel 44*a* formed between the dispensing chimney 44 and the assembly skirt 56. The sealing lip 58 is annular and bears closely against the radially inside surface of the top portion 48*c* of the neck 48, which surface is annular, thereby providing sealing between the lower container 42 and the upper container 44.

As illustrated in FIG. 14, during transport and before the first use, the opened end 54*b* of the upper container 44 is closed off by a temporary closing member 30. The closing member 30 is identical to the closing member shown in FIG. 4 and will not be further described. It is also possible to provide a closing member as the closing member shown in FIG. 6 or 9.

In the example illustrated, the closing member 30 is screwed, in a sealed manner, onto an outer thread 54*e* provided on the outer surface of the lower end 54*b* of the dispensing chimney 54, between the dispensing chimney 54 and the inner surface of the neck 48.

The cylindrical skirt 32 of the closing member 30 extends radially between the neck 48 of the lower container 42 and the dispensing chimney 54 of the upper container 44.

The cylindrical skirt 32 is provided on its inner cylindrical surface with inner threads 32*a* cooperating with the outer thread 54*e* of the dispensing chimney 54.

The cylindrical skirt 32 is further provided on its outer cylindrical surface with outer longitudinal ribs 32*b* (shown on FIG. 4) regularly spaced apart on the whole circumference of the cylindrical skirt 32. Said outer longitudinal ribs 32*b* cooperate with inner longitudinal ribs 48*d* provided on the inner circumferential surface of the neck 58, such that the closing member 30 is prevented from rotating relative to the lower container 42.

The upper face of the plug 34 comprises an annular sealing lip 34*a* having an outer diameter substantially equal to the inner diameter of the dispensing chimney 54 in order to be inserted into said dispensing chimney 54 and to close it in a sealed manner.

The device 40 is assembled as follows.

The upper container 44 is filled with the second product B and the closing member 30 is screwed onto the dispensing chimney 54 until the plug 34 bears axially against the opened end 54*b* of said dispensing chimney 54.

The upper container 44 is fitted in a simple translation movement along the longitudinal axis X-X' on the lower container 42 which has been previously filled with the first product A, until the assembly skirt 56 of the upper container 44 snap-fasten onto the neck 48 of the lower container 42.

In order to put the inner volume 54*c* of the upper container 44 in flow communication with the inner volume 52 of the lower container 52 on first use of the device 40, the user turns the upper container 44 relative to the lower container 42 in a first rotation direction F1, for example the direction as shown on FIG. 5, causing the closing member 30 to translate downwardly along the longitudinal axis X1-X1' compared to the lower container 42 until falling into the inner volume 52 of said lower container 42.

In a non-limited example, the first rotation direction may be a clockwise or counter-clockwise direction.

Once the closing member 30 is in the inner volume 52 of the lower container 42, said closing member acts as a stirring member for the mixture M comprising the first and second products A, B by twist and shaking movements of the device 40.

The user then breaks the frangible end-piece 54*a* for using the device 40 and dispensing the resulting mixture M contained in the lower container 54 through the dispensing chimney 54 and the dispensing orifice 54*d*.

The lower container 42 may be processed with the same injection blow molding process as the lower container 12 of the preceding embodiments and will not be further described.

The longitudinal anti-rotation ribs 48*d* are thus manufactured directly during injection blow molding process of the lower container 42.

Thanks to the device according to the present invention, it is possible to provide a device for packaging two separate products of simple structure and easy to manufacture.

Furthermore, thanks to the invention, there is not risk of obstructing the opening of the upper container when the closing member is located in the first product cavity of the lower container.

The invention claimed is:

1. Device for packaging two products separately and dispensing a resulting mixture on a first use, said device comprising a lower container delimiting a first product cavity containing a first product and an upper container comprising a dispensing chimney delimiting a second product cavity containing a second product and having a dispensing orifice, said upper container comprising an assembly skirt surrounding the dispensing chimney and snap-fitted on the lower container, such that the upper container is held axially relative to the lower container, while allowing a rotating movement one relative to the other, said containers being capable of rotating one relative to the other without moving axially, wherein said device further comprises a temporary closing member configured to close an opened end of the upper container before the first use, and comprising a cylindrical skirt surrounding said opened end and a plug connected to said cylindrical skirt, said cylindrical skirt being provided, on its inner cylindrical surface, with inner threads cooperating with outer threads provided on the dispensing chimney of the upper container and on its outer cylindrical surface, with first anti-rotation means cooperating with second anti-rotation means provided on the lower container for preventing rotation between the closing member and the lower container, wherein the closing member is deprived from any axially retaining members with both containers, such that when the upper container is rotated in a first rotation direction, the closing member translates downwardly until falling into the first product cavity.

2. Device according to claim 1, wherein the closing member comprises a bridge of hinge-forming material and at least one link of breakable material connecting the plug to the cylindrical skirt, such that when the upper container is rotated in a second rotation direction, opposite to the first rotation direction, the closing member translates upwardly until the breakable link is broken by force causing the plug to pivot around the bridge of hinge-forming material between a first position where the opened end is closed to a second position where the opened end is opened so that the second product to flow towards the first product cavity of the lower container.

3. Device according to claim 2, wherein the closing member comprises a plurality of links of breakable material regularly spaced apart on the circumference of the plug.

4. Device according to any of the preceding claims, wherein the closing member comprises at least one axially projecting block provided on a lower surface of the plug.

5. Device according to claim 4, wherein the closing member comprises a plurality of axially projecting blocks provided on the lower surface of the plug.

6. Device according to claim 5, wherein the blocks are disposed on the lower surface of the plug on a diameter of the plug substantially equal to the diameter of the opened end of the upper container.

7. Device according to any of the preceding claims, wherein the plug comprises an annular sealing lip on its upper surface configured to close the opened end of the upper container in a sealed manner.

8. Device according to claim 7, wherein the annular sealing lip is provided with an annular groove.

9. Device according to any of the preceding claims, wherein the upper container is provided with an annular axial sealing lip configured to bear closely against a radially inside surface of the lower container, thereby providing sealing between the lower container and the upper container.

10. Device according to claim 9, wherein the annular sealing lip of the upper container is provided with an outer annular groove.

11. Device according to any of the preceding claims, wherein the upper container comprises an upper portion, opposite to the open lower end, and having a dispensing frangible end piece designed to be broken for first use of said device in order to open a first dispensing orifice in flow communication with the second product cavity.

12. Device according to claim 11, wherein the upper container comprises a plurality of application teeth and wherein the frangible end-piece is located between said application teeth and provides access to a second dispensing orifice communicating with the first dispensing orifice.

13. Device according to any of the preceding claims, wherein the lower container is manufactured with injection blow molding process, such that the second anti-rotation means are manufactured directly during injection blow molding process of the lower container.

14. Device according to any of the preceding claims, wherein the first anti-rotation means are longitudinal ribs provided on the outer cylindrical surface of the cylindrical skirt, said longitudinal ribs cooperating with inner longitudinal ribs provided on the inner surface of the lower container.

* * * * *